United States Patent [19]

Kuin et al.

[11] Patent Number: 4,465,754

[45] Date of Patent: Aug. 14, 1984

[54] WATER-FIXABLE ELECTROSTATIC TONER POWDER CONTAINING HYDROLYZED POLYVINYL ESTER

[76] Inventors: Nicolaas P. J. Kuin, Grubbenvorst; Jozef J. A. Pleyers, Baarlo, both of Netherlands

[21] Appl. No.: 436,027

[22] Filed: Oct. 22, 1982

[30] Foreign Application Priority Data

Oct. 27, 1981 [NL] Netherlands ..... 8104843

[51] Int. Cl.[3] ..... G03G 9/08

[52] U.S. Cl. ..... 430/109; 430/904; 430/106.6; 430/97; 430/110

[58] Field of Search ..... 430/97, 104, 105, 107, 430/109, 110, 904, 106.6

[56] References Cited

U.S. PATENT DOCUMENTS

| | | | |
|---|---|---|---|
| 3,080,250 | 3/1963 | Claus | 430/104 X |
| 3,124,456 | 3/1964 | Moore | 430/69 X |
| 3,185,777 | 5/1965 | Rheinfrank | 430/107 X |
| 3,196,032 | 7/1965 | Seymour | 430/110 X |
| 3,677,759 | 7/1982 | Jones et al. | 430/291 |
| 4,058,470 | 11/1977 | Moschovis et al. | 430/114 |

FOREIGN PATENT DOCUMENTS

| | | |
|---|---|---|
| 1369344 | 2/1963 | France . |
| 7001601 | 8/1970 | Netherlands . |
| 1297826 | 8/1969 | United Kingdom . |

*Primary Examiner*—John D. Welsh

*Attorney, Agent, or Firm*—Albert C. Johnston

[57] ABSTRACT

A water fixable toner powder is provided for making powder images that can be transferred and fixed with good image quality onto receiving material such as paper by being covered with water, squeegeed and subsequently pressed against the receiving material. The individual particles of the toner powder consist essentially of hydrolyzed polyvinyl ester that is swellable but insoluble in water at a temperature up to 30° C., such preferably as polyvinyl alcohol having a degree of hydroylsis above 98% and an average molecular weight of at least 4,000, together with finely divided filler material that is insoluble and non-swellable in water and is present in an amount of between 10 and 60% by volume. Other additives such as coloring material and/or a polarity control agent may also be present in the binder of hydrolyzed polyvinyl ester. Preferred forms of the toner particles are porous and have a specific surface of between 0.6 and $2m^2/g$.

6 Claims, 1 Drawing Figure

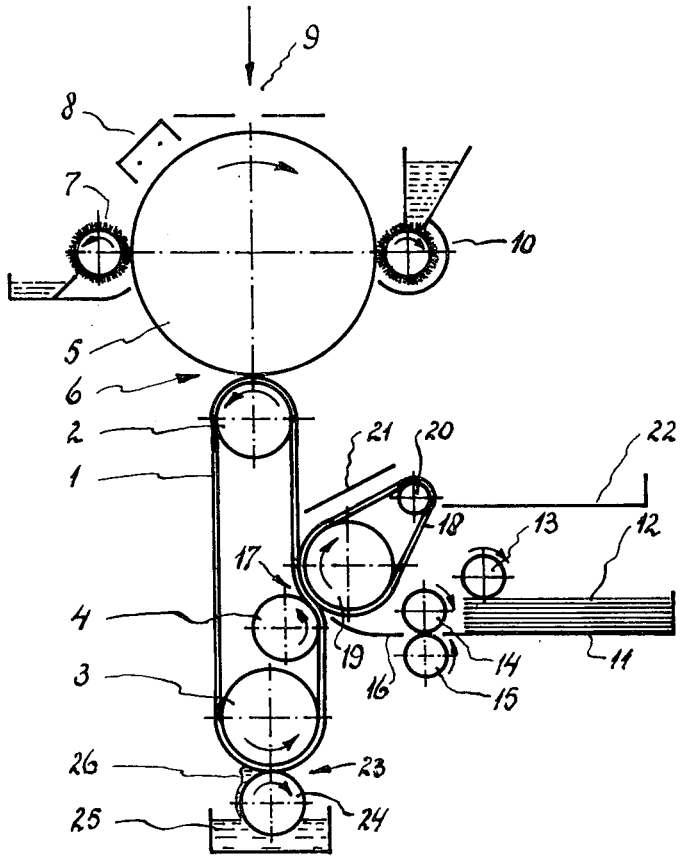
9
8
7
10
5
6
2
1
21
20
22
18
13
12
17
4
19
14
11
3
16
15
26
23
25
24

WATER-FIXABLE ELECTROSTATIC TONER POWDER CONTAINING HYDROLYZED POLYVINYL ESTER

This invention relates to a water-fixable toner powder and to a process for forming fixed images by use of the powder.

Certain water-fixable toner powders are described in French Pat. No. 1,369,344 as consisting of particles composed of one or more water-soluble binders and additives including one or more dyes. Fixed images can be obtained with such powders by transferring the powders imagewise onto a receiving support moistened with water, or by first applying the powders imagewise to a dry receiving support and then moistening the image-supporting surface with water.

Such known water-fixable toner powders, however, are disadvantageous in that the amount of water present on or applied to the image supporting surface must be controlled within narrow limits in order to produce a fixed image of good quality. If too much water is applied, the image indeed is fixed but it tends to flow out or deform so that image details are lost. To obtain fixed images of good quality with such toner powders, relatively compliated applicator devices are required by which the amount of water to be applied can be accurately controlled.

The principal object of the present invention is to provide a water-fixable toner powder with which the above mentioned disadvantage can be avoided, and fixed images of good quality obtained in a relatively simple and reliable way.

According to the invention, a water-fixable toner powder is provided the individual particles of which consist essentially of hydrolyzed polyvinyl ester binder that is swellable but insoluble in water at a temperature of up to 30° C., in admixture with finely divided filler material that is insoluble and non-swellable in water and in quantity amounts to between 10 and 60% of the volume of the toner particles.

The images formed with toner powder of this composition are satisfactorily water-fixable, as the quality of the fixed images is largely independent of the amount of water applied for fixing the images. Consequently, a relatively simple device can be used for fixing the images, without requiring a means for continuously supplying water to the images in a quantity within narrow limits.

The hydrolyzed polyvinyl ester to be used according to the invention possesses a degree of hydrolysis of at least 50%. Suitable binders are polyvinyl acetates having a degree of hydrolysis of between 55 and 65% or of 98% or more. The latter, substantially completely hydrolyzed materials are preferred, because they yield toner powders which adhere more firmly to image supports of conventional paper than do the toner powders made with polyvinyl esters hydrolyzed only to the extent of between 55 and 65%. The average molecular weight of the hydrolyzed vinyl ester is preferably at least 4,000, because a higher binding power for the filler material is obtained with such an ester.

Examples of commercially available binders for use according to the invention are: Mowiol Nos. 10-98, 28-99, 56-98, 66-100 from Hoechst A.G., Germany, and similar products from Rhône-Poulenc S.A., France (Rhodoviols), Du Pont de Nemours and Co., U.S.A.

(Elvanols), Dai Nippon Co., Japan (Ghosenols) and Wacker Chemie G.m.b.H., Germany (polyviols).

The particles of the toner powder according to the invention may contain various of the finely divided organic and inorganic filler materials that are known per se as being insoluble and non-swellable in water. Examples of suitable filler materials are pigmentary grades of zinc oxide, titanium dioxide, silica, aluminum oxide and carbon black, metal powders such as iron, nickel and copper powder, and chromium dioxide and ferrites in suitably finely divided forms. The particular filler material to be selected for incorporation in a toner powder also depends on the properties required in the toner powder in order to suit it for the intended manner of application to an image. For instance, magnetically attractable filler material with or without other filler material will be employed in toner powder that either is to be used for the development of latent magnetic information patterns or is to be fed by magnetic conveyor means to a latent electrostatic information pattern. In the case of toner powder that is to be relatively electrically conductive, the filler material should consist completely or at least in substantial part of electrically conductive material such, e.g., as carbon black.

The filler material is to be used in the form of fine particles that preferably are of less than 3 μm in size and are distributed substantially evenly in the binder of the toner particles. It is advantageous that the individual particles of the toner powder be to some extent porous and hence capable of rapidly absorbing the amount of water required for fixing them. The filler material is therefore preferably present not only in the interior of the toner particles but also at their surfaces. Very good results are obtained with toner powder containing 20–45% by volume of the filler material and having a specific surface of 0.6–2 $m^2/g$ as measured by the B.E.T. method in a Ströhlein Areameter.

In addition to the hydrolyzed polyvinyl ester binder and the filler material, the toner particles may also contain other additives that are known per se. For example, dyes can be added if the required color is not already produced by the filler material employed. Electrically conductive substances, e.g. antistatic substances, may also be contained in the toner particles or may be deposited onto their surfaces in order to bring the electrical properties of the toner powder to a required level. If the toner powder is to be used in a so-called two-component developing powder, a polarity control agent that determines the polarity of the charge applied tribo-electrically to the toner particles can be included in known manner in the toner particles.

The toner powder according to the invention can be prepared by dispersing the filler material in the required quantity in a solution of the hydrolyzed polyvinyl ester, then concentrating the dispersion to a solid mass and finally grinding the solid mass to obtain toner particles of the required size, which for most applications is between 5 and 50 μm and preferably is between 8 and 25 μm. The toner powder can also be obtained by spray-drying a solution of the polyvinyl ester in which the filler material is finely distributed.

Toner powders embodying the invention can be used for developing electrostatic charge patterns either as a one-component developing powder or in the form of a two-component developing powder. In the latter case the toner powder is mixed in known manner with carrier particles against which the toner particles can be charged up tribo-electrically in a copying machine so as to assume a charge having a polarity opposite to that of the charge pattern to be developed. If the toner powder is made with magnetically attractable filler material, the toner powder can also be used for developing magnetic image patterns.

The images formed with the toner powder of the invention can be fixed with water in a variety of ways, including those described in the above-mentioned French Pat. No. 1,369,344. According to a further feature of the invention, an image fixing process is employed in which an image of particles of the toner powder is applied to a transportable support having a hydrophobic surface, that support surface and the powder image present on it are moistened with water, a curved squeegeeing surface is then rolled over the imaged support to dry its hydrophobic surface, and the resultant moistened powder image subsequently is transferred by pressure onto a water-absorbing surface of a receiving support.

The above-mentioned and other objects, features and advantages of the invention will be further evident from the following description of an illustrative embodiment of the invention. The accompanying schematic drawing shows an apparatus for carrying out the image fixing process.

As illustrated diagrammatically in the drawing, the apparatus comprises a transportable intermediate support in the form of an endless belt which is tensioned over rollers 2, 3 and 4 and is driven in the direction indicated by arrows at a speed of, for example, 15 m/min.

The belt 1 comprises a flexible support which is, for example, made from a rubber-impregnated fabric and is provided with a resiliently deformable, hydrophobic top layer. A suitable top layer, for example, is an 0.1–1 mm thick layer of a commercially available silicone rubber having an intrinsic hardness of 30°–70° Shore A. Among such silicone rubbers are the products sold as RTV 200 (Possehl Chemie+Kunststoff GmbH, West Germany) and Silastic E (Dow Corning Corp., USA).

A photoconductive imaging member of known kind, for example, a rotatable drum 5 having a photoconductive surface, is driven in the direction indicated by an arrow at a peripheral speed equal to the surface speed of the belt 1. Ancillary devices as normally employed in an electrophotographic copying machine are arranged around the drum 5, such as a cleaning device 7, a charging device 8, an optical system 9 (not shown in detail) by which the image of an original to be copied can be projected onto the surface of drum 5, and a magnetic brush developing device 10.

An electrostatic latent image formed on the photoconductive drum surface via the optical system 9 is developed into a powder image by toner particles applied to it by the developing device 10, and the resultant powder image then is transported into a transfer zone 6 where, due to pressure of the deformable hydrophobic surface of belt 1 against the drum surface, the powder image is transferred onto the moving belt 1.

The apparatus further is provided with a table 11 to support a stack 12 of cut paper sheets and with a sheet feeding means, including e.g. a rotatable friction roller 13, by which sheets can be removed one by one from the stack 12 so as to be conveyed by the guide rollers 14 and 15 over a guide plate 16 and into a second pressure zone 17 of the belt 1. Each sheet thus fed into zone 17 is pressed by suitable pressing means, including a conveyor belt 18 tensioned over rollers 19 and 20, against a portion of belt 1 that is supported by the roller 4. A suitably prepared powder image being carried on the surface of belt 1 can thus be transferred to a fed paper sheet which, after being carried through zone 17, is conveyed by belt 18 past a guide 21 and then is deposited onto a copy receiving table 22.

In a third zone 23 of the path of belt 1, which, as viewed in the direction of the belt movement, is located between the zones 6 and 17, the belt 1 is kept in pressure contact with a squeegee roller 24. This roller may consist, for example, of a metal core covered by a smooth rubber layer. The roller 24 is driven at the same surface speed as belt 1, in the direction indicated by an arrow, and a lower part of its surface is kept immersed in a body of water present in a bath 25. Consequently, as the roller 24 is rotated it carries water on its surface from bath 25 up to the nip in pressure zone 23 where this water is held back. Thus, a meniscus 26 of water is formed and maintained in a region in front of the pressure zone 23, from which any excess water will flow back into the water bath 25.

In the operation of the apparatus, a latent charge image is formed on the surface of the imaging member 5, in ways known for use in electrophotographic copying processes, by successfully cleaning, charging electrostatically and imagewise exposing the photoconductive surface. The latent image then is developed with water-fixable toner powder according to the invention, thus forming a visible powder image which in zone 6, under the influence of the pressure exerted there, is forced against and into the surface of belt 1 so that it adheres to the belt 1 and thus is transferred from member 5 onto the belt 1. By a suitable selection of the pressure in zone 6 in relation to the hardness of the top layer of belt 1, such a strong adhesion can be obtained between the power image and the belt 1 that an extremely high transfer yield will be obtained (e.g. 85–95%).

The powder image transferred to belt 1 in zone 6 is carried by the belt 1 into the water meniscus 26 present in front of the pressure zone 23, where the powder image is covered and moistened with water and, immediately afterward, the free water is directly squeezed away by roller 24 as the belt traverses the nip in zone 23. The image powder in the meniscus absorbs water which is retained during passage of the image through zone 23, and as a result of the pressure exerted in zone 23 the moistened image powder is pressed at least partially into the surface of belt 1; yet due to pressure in zone 23 and to the hydrophobic nature of the surface of belt 1, substantially all other water applied to the surface of belt 1 is kept back. Thus, upon traversing zone 23, the surface of belt 1 is practically dry and only the powder image adhering thereto remains moistened.

While the image is being carried beyond zone 23 by belt 1 the moistened image powder softens and becomes deformable and sticky. Then, in zone 17, the softened image is pressed against a sheet of paper that in the meantime has been fed into zone 17 by the rollers 13, 14 and 15. The pressure so applied causes the softened image particles to be engaged and adhered onto and between the fibers of the paper sheet. At the same time, water present in the image material is given off to and absorbed in the adjacent paper fibers so that, upon traversing zone 17, the image itself is dried and is durably bonded with the paper. Hence, on leaving zone 17 a firmly fixed and substantially dry copy is obtained which can be handled immediately upon being deposited onto table 22 by conveyor belt 18.

A toner powder very suitable for use in the process described above was prepared as follows: 250 g of hydrolyzed polyvinyl ester (Mowiol 10-98 of Hoechst A.G., Germany) was dissolved in 1000 ml of water at a temperature of 95° C. Subsequently 500 g of Bayferrox 318M (of Bayer A.G., Germany) was finely dispersed in the solution. After cooling the mixture down to room temperature, the viscous mass was dried to the air. The dried product was finally broken and ground into particles having sizes in the range of 8–25 μm.

We claim:

1. A water-fixable toner powder the individual particles of which consist essentially of binder and additive distributed therein, said binder consisting essentially of an at least 50% hydrolyzed polyvinyl ester that is swellable but insoluble in water at a temperature below 30° C. and said additive being principally finely divided filler material of less than 3 μm in particle size that is insoluble and non-swellable in water and is present in an amount of between 10 and 60% of the volume of said toner particles.

2. A toner powder according to claim 1, said polyvinyl ester being polyvinyl acetate having a degree of hydrolysis above 98% and an average molecular weight of at least 4,000.

3. A toner powder according to claim 1, said filler material being an inorganic pigment.

4. A toner powder according to claim 1, said filler material being magnetically attractable inorganic pigment.

5. A toner powder according to claim 1, said toner particles being porous and having a specific surface of between 0.6 and 2 $m^2/g$.

6. A toner powder according to claim 1, said polyvinyl ester being polyvinyl acetate having a degree of hydrolysis of at least about 98% and an average molecular weight of at least 4,000, said filler material being predominantly magnetically attractable inorganic pigment and being present in an amount of between 20 and 45% by volume, said toner particles being porous and of about 8 to 25 μm in size and having a specific surface area of between 0.6 and 2 $m^2/g$.

* * * * *

UNITED STATES PATENT OFFICE

CERTIFICATE OF CORRECTION

Patent No. 4,465,754 Dated August 14, 1984

Inventor(s) Nicolaas P. J. Kuin and Jozef J. A. Pleyers

It is certified that error appears in the above-identified patent and that said Letters Patent are hereby corrected as shown below:

In the heading, directly above the line reading "[21] Appl. No. 436,027," insert:

--[73] Assignee: Océ-Nederland B.V., Venlo, The Netherlands--

Signed and Sealed this

Twelfth Day of March 1985

[SEAL]

*Attest:*

DONALD J. QUIGG

*Attesting Officer* *Acting Commissioner of Patents and Trademarks*